United States Patent [19]

Inspector

[11] Patent Number: 4,497,080

[45] Date of Patent: Feb. 5, 1985

[54] BOOT TREE

[76] Inventor: Elizabeth Inspector, 14 Saint Malo, Pine Brook, N.J. 07058

[21] Appl. No.: 473,780

[22] Filed: Mar. 10, 1983

[51] Int. Cl.[3] ..... A43D 03/14

[52] U.S. Cl. ..... 12/128 R; 223/75; D2/378.1

[58] Field of Search ..... 36/1; 12/114.8, 128 R, 12/128 B; D2/378.1; 223/66, 75, 77, 78, 79, 80, 120

[56] References Cited

U.S. PATENT DOCUMENTS

| | | | |
|---|---|---|---|
| D. 163,106 | 5/1951 | Evans | D2/378.1 |
| D. 165,151 | 11/1951 | Golden | D2/378.1 |
| 921,570 | 5/1909 | Van Heusen | 12/128 B |
| 992,893 | 5/1911 | McCabe et al. | 12/128 R |
| 1,892,300 | 12/1932 | DeWitt | 12/128 R |
| 2,606,700 | 8/1952 | Goodfellow | 223/75 |
| 2,722,350 | 11/1955 | Kleutgen | 223/75 |
| 3,200,427 | 8/1965 | Daley | 12/128 R |
| 3,979,786 | 9/1976 | Vierra et al. | 12/128 B |
| 4,400,840 | 8/1983 | Sly | 12/128 R |

FOREIGN PATENT DOCUMENTS

| | | | |
|---|---|---|---|
| 455608 | 4/1949 | Canada | 223/77 |

*Primary Examiner*—Werner H. Schroeder
*Assistant Examiner*—Steven N. Meyers
*Attorney, Agent, or Firm*—Lerner, David, Littenberg, Krumholz & Mentlik

[57] ABSTRACT

A boot and shoe tree is described for maintaining a pair of boots or shoes in adjacent relationship for storage while being self-standing when not in use. The boot or shoe tree is constructed from a pair of adjacent members joined together at one end and filled with material to provide the members with a self-supporting quality, in addition to a weight provided at the lower end thereof to provide the boot or shoe tree with a self-standing quality.

8 Claims, 6 Drawing Figures

FIG. 1
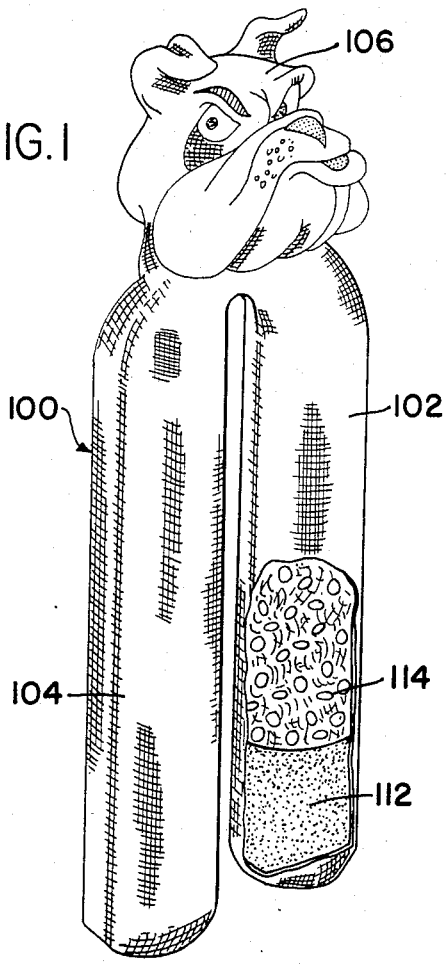
FIG. 2a
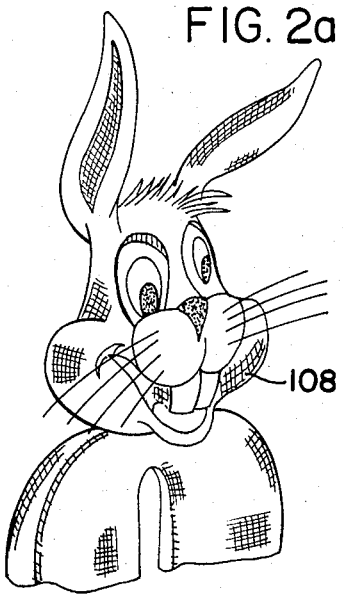
FIG. 2b
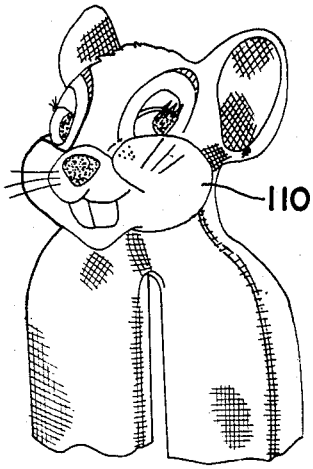
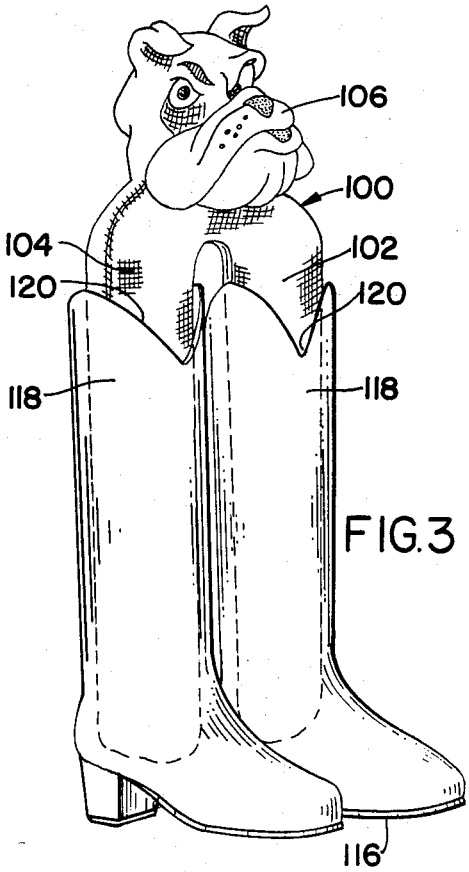
FIG. 3

BOOT TREE

BACKGROUND OF THE INVENTION

The present invention relates in general to an article for use in combination with a pair of foot coverings and, more particularly, to such an article commonly referred to as a boot stuffer or boot tree for maintaining a pair of boots, shoes or the like in adjacent storage relationship while being constructed to be self-standing when not in use.

Boots and shoes are generally kept in one's bedroom or closet. As one usually possesses a number of pairs of such boots and shoes, they often become randomly intermixed in nonmatching pairs, as well as being scattered about the bedroom or closet floor. A need has been recognized for providing a way of maintaining these boots and shoes in pairs in an organized and orderly fashion so as to prevent their loss or accidental exchange.

In accordance with the prior art, a number of devices for maintaining boots and shoes together are known. For example, in each of U.S. Pat. Nos. 3,889,399 and 1,300,998 there is disclosed a device for strapping boots and shoes together to be hung over a hook mounted on a wall. However, these devices require that a member be specially attached to a portion of the boot or shoe. It can be readily appreciated that the need to permanently and specially modify a boot or shoe to provide for the device is a great disadvantage. Likewise, the device of U.S. Pat. No. 3,041,743 requires that a hole be provided in the upper portion of a boot to specially attach the device thereto. The destruction of the boot by providing a hole therein is undesirable as being unsightly due to the visual presence of the device and due to the permanent nature of the hole should the device be removed. Further, in U.S. Pat. No. 2,965,237, there is disclosed a device which utilizes a spring biased arm having a pair of rodlike extensions at one end for pressing a pair of shoes downward against an underlying support plate. This device, in addition to being expensive to manufacture as a result of its complicated assembly, is unsightly when in ones bedroom or closet and requires a great deal of space for mounting and use.

Accordingly, it can be appreciated that there is an unsolved need for an article for use in combination with a pair of boots, shoes and the like for maintaining same in pairs while being stored without the necessity of attaching special devices to such boots or shoes and which is appealing to look at while occupying a minimum of space when not in use.

SUMMARY OF THE INVENTION

It is broadly an object of the present invention to provide a boot or shoe tree constructed and arranged in a manner which overcomes or avoids one or more of the foregoing disadvantages resulting from the use of the above-mentioned prior art devices and, which fulfills a specific requirement of such a boot or shoe tree as noted herein. Specifically, it is within the contemplation of one aspect of the present invention to provide a boot or shoe tree for use in combination with a pair of boots, shoes and the like for maintaining same in pairs while being stored and which boot or shoe tree is constructed and arranged to be self-standing when not in use.

A further object of the present invention is to provide a boot or shoe tree which is pleasing to look at when not in use.

A still further object of the present invention is to provide a boot or shoe tree which does not require the special alteration of a boot or shoe for use therewith.

A yet still further object of the present invention is to provide a boot or shoe tree of simple and inexpensive construction which avoids the complicated mechanical assemblies of the prior art devices.

A yet still further object of the present invention is to provide a boot or shoe tree of unitary construction.

In accordance with one embodiment of the present invention, there is provided an article for use in combination with a pair of foot coverings, for example, boots, shoes and the like. The article comprises a pair of adjacent members joined together at one end thereof, the members being constructed and arranged to be inserted into a portion of the interior of a pair of foot coverings for maintaining the pair of foot coverings in adjacent relationship. Means are provided for permitting the article to be self-standing when the members are removed from the interior of the pair of foot coverings.

In accordance with the above embodiment, the adjacent members are constructed of self-supporting tubular members filled with a combination of beads or the like and shredded material.

Still further in accordance with the above embodiment, the means for causing the article to be self standing comprises a weight selected from material such as sand, gravel, pebbles and stones and, further including a fragrance therein.

BRIEF DESCRIPTION OF THE DRAWINGS

The above description, as well as further objects, features and advantages of the present invention will be more fully understood by reference to the following detailed description of a presently preferred, but nonetheless illustrative, boot or shoe tree in accordance with the present invention when taken in conjunction with the accompanying drawings, wherein:

FIG. 1 is a perspective view showing the boot tree of the present invention constructed from a pair of adjacent tubular members joined together at one end thereof and, one such member having a section removed for showing a weight comprising sand at the other end of such members and the remainder of such members being filled with a mixture of beads and shredded material;

FIGS. 2*a* and 2*b* are front views showing various designs suitable as head portions for the boot tree of the present invention as shown in FIG. 1;

FIG. 3 is a perspective view of the boot tree in accordance with the present invention as shown in FIG. 1 having its tubular members slidably engaged within the upper portion of a pair of boots maintaining same in adjacent storage relationship;

DETAILED DESCRIPTION

Figure 4:
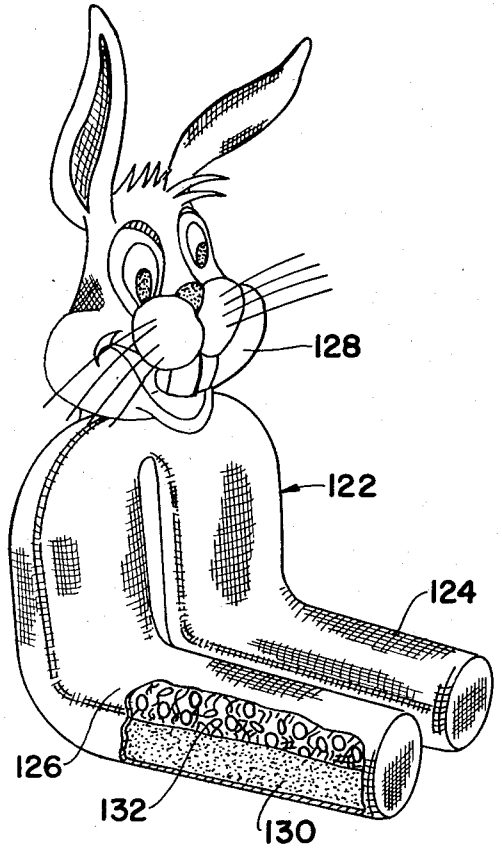
FIG. 4 is a perspective view of a shoe tree in accordance of another embodiment of the present invention constructed from a pair of L-shaped tubular members joined together at one end thereof and, having a section of one of such members removed for showing a weight comprising sand at the other end of such members and the remainder of such members being filled with a mixture of beads and shredded material.

Referring generally to the drawings in which like reference characters represent like elements, there is shown in FIG. 1 a perspective view of a boot tree constructed from a body 100 having a pair of adjacent tubular members 102, 104 joined at their upper end and integrally formed thereat with a head portion 106. The body 100 is generally constructed from fabric like material, for example, cotton, corduroy, satan, polyester blends, as well as plastic and the like. The fabric like material is integrally formed into the tubular members 102, 104 and head portion 106 by means known to those skilled in the art, for example, sewing, glueing or heat sealing. However, the tubular members 102, 104 and head portion 106 may be formed as separate members and joined thereafter in a similar manner. As shown in FIG. 1, the head portion 106 can be constructed in the likeness of an animated object or any other such design as desired, for example, of the design of the head portions 108, 110 as shown in FIGS. *2a* and *2b*.

Referring again to FIG. 1, the lower end of each tubular member 102, 104 is provided with a weight 112 such as sand, gravel, pebbles, stones and the like. In the preferred embodiment, approximately one-half pound of sand having a refreshing scent or fragrance added thereto is provided within the bottom portion of each tubular member 102, 104. The scent or fragrance is suitable for freshening the surrounding atmosphere when the boot tree is not in use, as well as functioning as a deoderizer when in use. The function of the weight 112 will be described hereinafter.

The remainder of the tubular members 102, 104, as well as the head portion 106 is stuffed with a variety of material 114 so that the body 100 is self-supporting. For example, the body 100 may be stuffed with shredded foam rubber, polyester fiber, polystyrene beads, garnet, shredded Pamper or other disposable diaper material, and mixtures thereof. In the preferred embodiment, a mixture of polystyrene beads and shredded Pamper material is used. Such mixture is in a flowable form and can therefore be used in automatic machinery for stuffing the body 100. Also, an inflatable balloon type liner (not shown) may be provided within each of the tubular members 102, 104 and head portion 106 as a substitute for the foregoing material.

The function of the weight 112 is to lower the center of gravity of the boot tree such that it will stand alone or be self-standing when not in use. By self-standing, it is meant that the boot tree will possess relative stability by not being top heavy when standing alone or when leaning against a wall, furniture or other such object. It is therefore to be noted that the term self-standing is to be interpreted in its broadest sense to include all condition where the boot tree may be maintained in such a vertical orientation. To maintain a low center of gravity of the boot tree, the remaining portion of the tubular members 102, 104, as well as the head portion 106 are filled with the foregoing material 114 which are light in weight. This not only prevents the boot tree from being top heavy thereby increasing its stability, but also the foregoing materials are relatively inexpensive providing another advantage to their use. The tubular members 102, 104 and head portion 106 are sufficiently stuffed with the material 114 such that the boot tree takes on a three dimensional and self-supporting form. Although the boot tree has been described as being stuffed with various material 114 and various weights 112, it is to be understood that various other such materials and weights may be used without departing from the spirit and scope of the present invention.

Referring to FIG. 3, the use of the boot tree will now be described. As shown, a pair of boots 116 are provided with an extending upper portion 118 having a longitudinal opening 120 extending through the interior thereof. In use, the tubular members 102, 104 of the boot tree are respectively inserted into the openings 120 of the upper portion 118 of the pair of boots 116. The tubular members 102, 104 extend coextensively along the upper portion 118 until the lower end of the tubular members are supported by the bottom of the boots, as illustrated in phantom. The pair of boots 116 are now maintained in adjacent stored relationship and can be stored neatly and conveniently in a bedroom or closet without concern of the boots getting lost or being exchanged with other boots or shoes. In addition, where the upper portion 118 of the pair of boots 116 is of soft flexible leather, as often found in women's boots, the boot tree of the present invention keeps the upper portion from collapsing and folding upon themselves on the floor where they are apt to be creased, stepped on or damaged.

Referring to FIG. 4, a shoe tree in accordance with another embodiment of the present invention is shown. The shoe tree is constructed in a similar manner to the boot tree as illustrated in FIG. 1 and will accordingly be only briefly described. The shoe tree 122 is constructed from a body 122 having a pair of L-shaped tubular members 124, 126 joined at one end thereof adjacent a head portion 128. The free ends of the L-shaped tubular members 124, 126 are constructed and arranged to be received within an opening provided in a pair of shoes as to be described hereinafter. Each of the L-shaped tubular members 124, 126 are stuffed in a similar manner to that of the boot tree as described with reference to FIG. 1. Specifically, a weight 130 such as sand, gravel, pebbles or stones is provided within a portion of the L-shaped tubular members 124, 126 to lower the center of gravity of the shoe tree to permit it to be self-standing by increasing its stability when not in use. The remainder of the L-shaped tubular members 124, 126 are stuffed with material 132 of the type previously described, such as polystyrene beads and shredded material. Likewise, the head portion 128 is also filled with such material.

Figure 5:
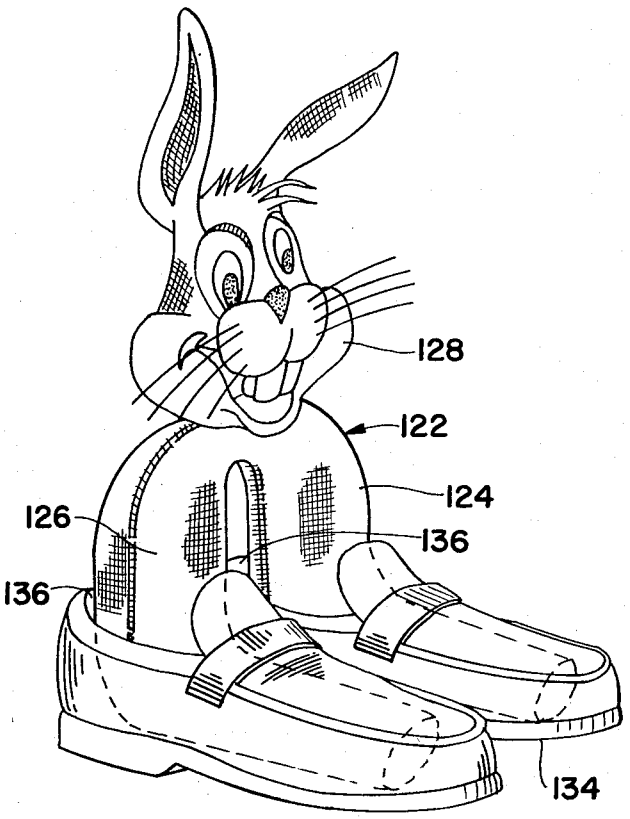
FIG. 5 is a perspective view of a shoe tree in accordance with the present invention as shown in FIG. 4 having its L-shaped tubular members slidably received within a portion of a pair of shoes for maintaining same in adjacent storage relationship.

Briefly referring to FIG. 5, the shoe tree is disclosed in use in combination with a pair of shoes 134. The shoes 134 are provided with an opening 136 adapted to receive the free end of the L-shaped tubular members 124, 126 of the shoe tree. The L-shaped tubular members 124, 126 extend within a portion of the interior of the shoes 134 as illustrated in phantom. In this regard, the shoe tree maintains the the pair of shoes 134 in adjacent storage relationship in a neat and organized manner, as well as preventing the shoes from being accidently exchanged with other shoes or becoming lost.

In accordance with the present invention, there has thus far been described an article for use in combination with a pair of foot coverings comprising a pair of tubular members arranged adjacent each other and joined together at one end thereof. The other end of the members are constructed and arranged to be inserted into a portion of the interior of the pair of foot coverings for maintaining the pair of foot coverings in adjacent relationship. Means are provided within a portion of the tubular members at the other end thereof for causing the article to be self-standing when the tubular members are removed from the interior of the pair of foot coverings. Further, means are provided within the remainder of the tubular members for causing the tubular members to be self-supporting.

Although the invention herein has been described with reference to particular embodiments, it is to be understood that these embodiments are merely illustrative of the principals and application of the present invention. It is therefore to be understood that numerous modifications may be made in the illustrative embodiments and that other arrangements may be devised without departing from the spirit and scope of the present invention as defined by the appended claims.

What is claimed is:

1. An ornamental article for maintaining, when in use, a pair of footwear in adjacent relationship, said article comprising a pair of tubular members arranged adjacent each other and joined together at one common end thereof, an ornamental head portion attached said one common end of said pair of tubular members, means within a portion of said tubular members at an end opposite the common end thereof for lowering the center of gravity of said article whereby said article can be maintained in a vertical orientation when not in use, said means for lowering the center of gravity of said article comprising a flowable material, and means within the remainder of said tubular members for maintaining the tubular shape of said tubular members whereby said tubular members can be inserted into a portion of the interior of said pair of footwear for maintaining said pair of footwear in adjacent relationship.

2. The article as set forth in claim 1 wherein said means for lowering the center of gravity of said article comprises sand.

3. The article as set forth in claim 1 wherein said pair of footwear comprise a pair of boots having an upper portion.

4. The article as set forth in claim 1 wherein said tubular members are dimensioned to be slidably received within an upper portion of said footwear.

5. The article as set forth in claim 1 wherein said pair of footwear comprise a pair of shoes.

6. The article as set forth in claim 5 wherein said members are L-shaped.

7. The article as set forth in claim 1 wherein said means for lowering the center of gravity of said article includes a fragrance added thereto.

8. An ornamental article for maintaining, when in use, a pair of footwear in adjacent relationship, said article comprising a pair of tubular members arranged adjacent each other and joined together at one common end thereof, an ornamental head portion attached to said one common end of said pair of tubular members, means within a portion of said tubular members at an end opposite the common end thereof for lowering the center of gravity of said article whereby said article can be maintained in a vertical orientation when not in use, and means within the remainder of said tubular members for maintaining the tubular shape of said tubular members, said means for maintaining the tubular shape of said tubular members comprising a combination of beads and shredded material, whereby said tubular members can be inserted into a portion of the interior of said pair of footwear for maintaining said pair of footwear in adjacent relationship.

* * * * *